United States Patent [19]

Kawai et al.

[11] Patent Number: 4,540,104

[45] Date of Patent: Sep. 10, 1985

[54] DEVICE FOR SEALING THE FLOATING ROOF OF AN OIL TANK

[75] Inventors: Koichi Kawai; Minoru Mikuriya, both of Yokohama, Japan

[73] Assignee: Nippon Kokan Kabushiki Kaisha, Tokyo, Japan

[21] Appl. No.: 594,114

[22] Filed: Mar. 28, 1984

[30] Foreign Application Priority Data

Sep. 12, 1983 [JP] Japan ..... 58-167859

[51] Int. Cl.[3] ..... B65D 88/42; B65D 88/46

[52] U.S. Cl. ..... 220/224; 220/222

[58] Field of Search ..... 220/224, 222

[56] References Cited

U.S. PATENT DOCUMENTS

| | | | |
|---|---|---|---|
| 1,673,984 | 6/1928 | Kuhl | 220/224 |
| 2,897,998 | 8/1959 | Ulm | 220/224 |
| 2,987,215 | 6/1961 | Joor, II | 220/224 |

FOREIGN PATENT DOCUMENTS

| | | | |
|---|---|---|---|
| 229799 | 10/1963 | Denmark | 220/222 |

*Primary Examiner*—Allan N. Shoap

*Attorney, Agent, or Firm*—Frishauf, Holtz, Goodman & Woodward

[57] ABSTRACT

A floating roof-type oil-tank sealing device wherein an inclined connector extends between an upper portion of a seal shoe and the lower portion of outer rim of a floating pontoon, and in such a state that each end of the inclined connector is pivotally supported by means of an inserted pin. A compression spring applies pressure to the inclined connector, thereby causing the seal shoe to slidably contact the peripheral tank wall. A seal member is provided between the outer rim of the pontoon and seal shoe in contact with the level of a stored oil. One end of a weather hood is fixed to the upper portion of the seal shoe, and the other end of the weather hood is made to slide along the surface of an inclined guide provided at the edge of the upper plate of the pontoon.

2 Claims, 14 Drawing Figures

DEVICE FOR SEALING THE FLOATING ROOF OF AN OIL TANK

BACKGROUND OF THE INVENTION

1. Field of the Invention

This invention relates to a sealing device provided on the outer rim of the floating roof of an oil tank.

2. Description of the Prior Art

A sealing device, interposed between the inside of the peripheral wall of a floating roof type oil tank and the outside of the outer rim of said floating roof, is broadly classified into two types. One type is the so-called soft seal which is constructed by wrapping an elastic-body prepared from, for example, urethane foam, in a liquid-proof oil-resistant covering formed of, for example, nitrile butadiene rubber (NBR). The other type is the so-called mechanical seal which is constructed by closely attaching a slidable plate (referred to as "a seal shoe") to the surface of the peripheral wall of an oil tank by a mechanical force, and covering an interstice, defined between the floating roof and seal shoe, with a flexible material. The former type has been designed in anticipation of the occurrence of a fire which might arise due to a collision between the seal device and the peripheral tank wall when the oil level is made to sway vigorously as, for example, during an earthquake. However, said former type of sealing device is accompanied with drawbacks in respect to the wear resistance or oil-resistance of a sealing material such as NBR and the durability of an elastic material such as urethane foam, which might be reduced by compression creeping. Therefore, a seal used in an earthquake-free district mainly consists of the latter mechanical type.

FIGS. 1 and 2 illustrate the different but widely accepted techniques of the mechanical seal, including the peripheral wall 1 of a tank, a seal shoe 2, a connector 3' of the seal shoe 2 and a floating pontoon 5. Also shown is a seal 4'. The space between the pontoon 5 and tank wall 1 varies within a certain range due to errors in the roundness of a manufactured peripheral tank wall, and the vertical movement of a floating roof, caused by the efflux or influx of storage liquid. Therefore, the seal shoe 2 always has to be tightly attached to the tank wall 1 in conformity to the aforementioned change in the space between said pontoon 5 and tank wall 1. The mechanical seal techniques, shown in FIG. 1 and 2, differ from each other in the process of applying pressure in order to attach the seal shoe 2 tightly to the peripheral tank wall 1. FIG. 1 illustrates the process of applying said pressure by means of a plate spring 3''. FIG. 2 indicates the process of applying said pressure by utilizing a weight 6 as a counterweight.

Throughout FIGS. 1 and 2, however, the seal 4' of the sealing device is so designed as to connect the upper portion of the seal shoe 2 and that of the floating roof 5. Therefore, a free level of stored oil is always present outside the peripheral wall of the floating roof 5. This condition has departed far from the fundamental object of an oil tank, which is minimizing the evaporation of stored oil to the best possible extent. The aforementioned seal 4' which in the past has been formed of NBR, for example, raises problems in respect to weatherproofness, for instance, the prevention of rain seepage.

SUMMARY OF THE INVENTION

This invention has been accomplished in view of the above-mentioned problems, and it is intended to provide a floating roof-type sealing device which ensures satisfactory sealing and effectively prevents rain drops from entering an oil tank.

To attain the above-mentioned objective, this invention provides a floating roof-type sealing device for an oil tank which comprises:

- an inclined connector which stretches between the lower portion of the outer rim of a pontoon-type floating roof and the upper portion of a seal shoe, slidable over the inside of the peripheral tank wall, and is pinned at both ends;
- a spring which is stretched between the inclined connector and the outer rim of the pontoon;
- a seal member, provided between the lower portion of the outer rim of the pontoon-type floating roof and that portion of the seal shoe, which faces said lower portion of the outer rim in contact with an oil level; and
- a weather hood of which one end is connected to the upper end of the seal shoe, and the other end of which allows for the sliding of a guide fitted to the upper end of the pontoon.

BRIEF DESCRIPTION OF THE DRAWINGS

FIG. 3 schematically illustrates the oil-tank sealing device of the invention;

DETAILED DESCRIPTION OF THE PREFERRED EMBODIMENT

Figure 1:
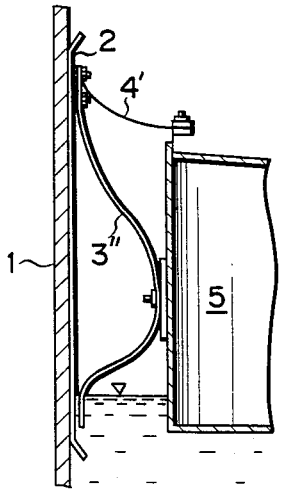
FIG. 1 PRIOR ART
FIGS. 1 and 2 illustrate different conventional oil-tank sealing devices.
Figure 2:
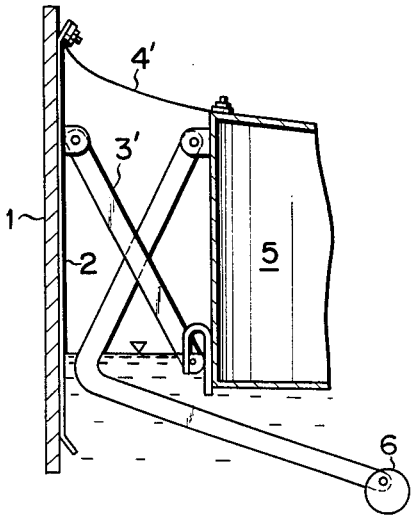
FIG. 2 PRIOR ART
Figure 3:
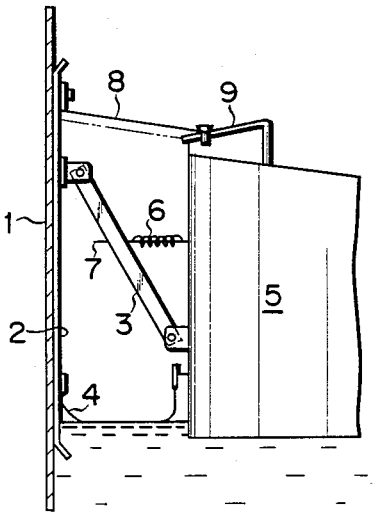
FIG. 3 and the following figures relate to an oil tank-sealing device embodying this invention.

A sealing device embodying the invention for an oil tank, is roughly described with reference to FIGS. 3 and 4. An inclined connector 3, extended between the lower end of the outer rim of a pontoon-type floating roof 5 and the upper portion of a seal shoe 2, is pinned at both ends. A compression spring 6 presses the inclined connector 3 extending between the seal shoe 2 and pontoon outer rim. Said compression spring 6 is guided by a rod 7 whose proximal end is fixed to the pontoon outer rim and whose distal end is inserted into the inclined connector 3. A seal member 4 is provided between the pontoon outer rim and that portion of the seal shoe which faces said outer rim. A weather hood 8 has one end which is connected to the upper end of the seal shoe 2, and the other end of the hood 8 slides along the surface of an inclined guide 9.

The above-mentioned arrangement causes the seal shoe 2 to be tightly fitted to the peripheral tank wall 1 by its own weight and the pressure applied by the compression spring 6. Even when, therefore, the floating roof slides sidewise, a good attachment is retained between the seal shoe 2 and the peripheral tank wall 1. Furthermore, said floating roof is always positioned at the center of the tank. The seal member 4, set in contact with the oil level, is effective in minimizing the evaporation loss of stored oil. If provided in a sagging state in anticipation of the sidewise slide of the floating roof, the seal member 4 can be saved from breakage. The weather hood 8 is constructed by using a press to bend the four sides of a metal plate, as shown in FIG. 4, and has a great mechanical strength. Moreover, the weather hood 8, bolted to the seal shoe 2 at one end, effectively prevents the intrusion of rain drops into the oil tank and further slides along the surface of the inclined guide 9 provided at the edge of the upper plate of the pontoon 5. This prevents the weather hood from undergoing excessive stresses and ensures improved durability.

Figure 5:
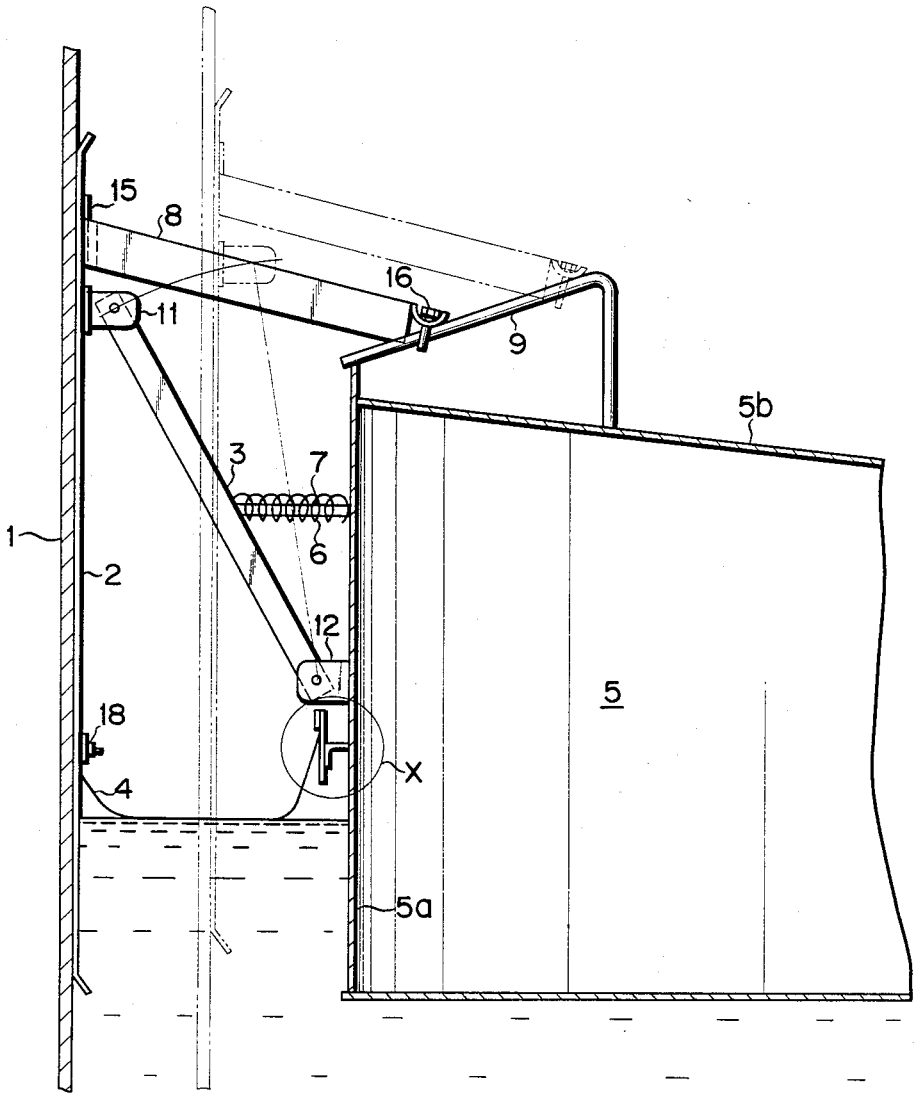
FIG. 5 is an enlarged, longitudinal view of the sealing device of the invention.
Figure 6:
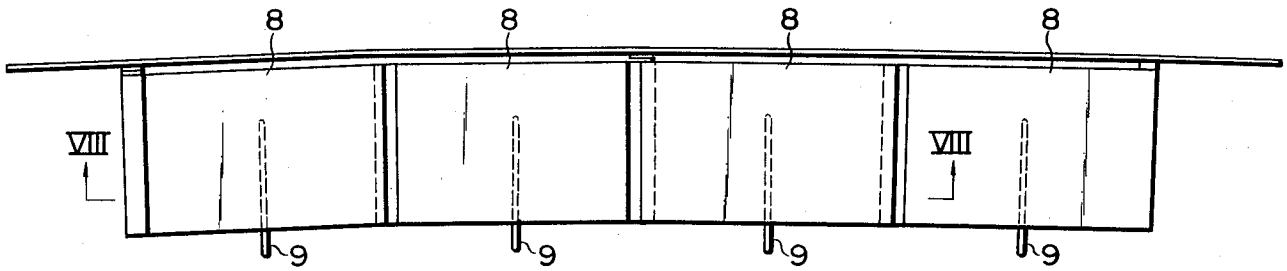
FIG. 6 is a plan view showing the condition in which the weather hood is set.

A concrete description may now be made with reference to FIG. 5 and the following illustrations of an oil tank-sealing device embodying this invention. The sealing device is constructed under the following conditions:

| | |
|---|---|
| Standard seal space (an interstice between the peripheral tank wall 1 and pontoon outer rim 5a) | about 300 mm |
| Minimum seal space | about 200 mm |
| Maximum seal space | about 400 mm |
| Circumferential length of a seal shoe 2 | 1.5 to 3 m |
| Number of weather hoods 8 provided for the seal shoe 2 | 2 to 4 |
| Material of the seal shoe 2 and weather hood | a metal plate having a thickness of 1.6–2 mm (prepared from galvanized iron, stainless steel, brass, or aluminum) |

Figure 9:
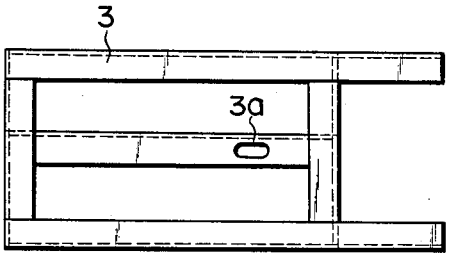
FIG. 9 is a plan view of an inclined connector.

The inclined connector 3 is constructed by welding together shaped steel members in the form illustrated in FIG. 9. The central member is provided with a slit 3*a*, allowing for the insertion of the guide rod 7 of the compression spring 6. The upper end of the seal shoe 2 is fitted with a bracket 11. This bracket 11 is provided with projections 11*a* which are respectively intended to pivotally support the upper end of the inclined connector 3 by means of an inserted pin. The lower end of the outer rim 5*a* of the pontoon 5 is fitted with another bracket 12 having the same construction as the aforementioned bracket 11. A single inclined connector 3 is provided for the seal shoe 2 in the state pivotally supported by the brackets 11 and 12, each provided with a projection penetrated by a pin.

Figure 7:
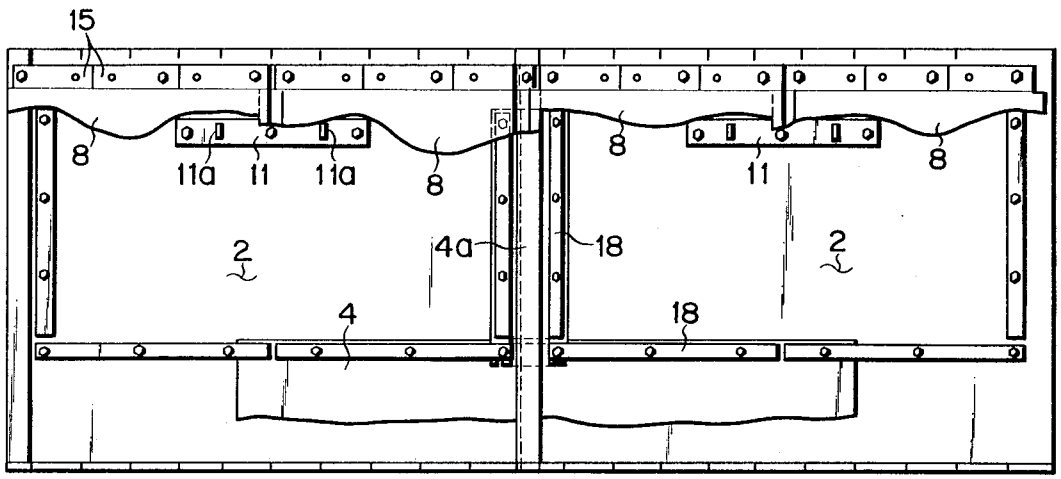
FIG. 7 is a lateral view showing the condition in which the seal plate is provided.
Figure 10:
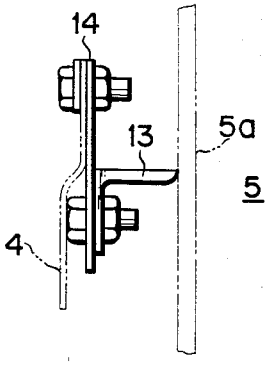
FIG. 10 is an enlarged cross sectional view of the X section of FIG. 5.
Figure 11:
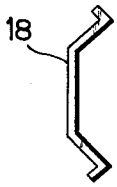
FIG. 11 is a cross sectional view of a keep plate.

As shown in FIG. 10, a shaped steel member 13 is welded to the peripheral wall of the outer rim 5*a* of the pontoon 5. A fitting plate 14 is bolted to the shaped steel member 13. The seal member 4 is attached to said fitting plate 14 at one end and to a seal shoe 2 by means of a keep plate 18 at the other end in a position facing said fitting plate 14. The seal member 4 has a sufficient length to cope with variations in the seal space. The keep plate 18 has a cross sectional shape, shown in FIG. 11. A seal member 4*a* is also inserted between the adjacent seal shoes 2 by means of the keep plate 18 in order to prevent released oil vapors from entering the seal space (FIG. 7). Said seal member 4*a* is fitted with a certain spatial margin to allow for the free displacement of the adjacent seal shoes.

Figure 4A:
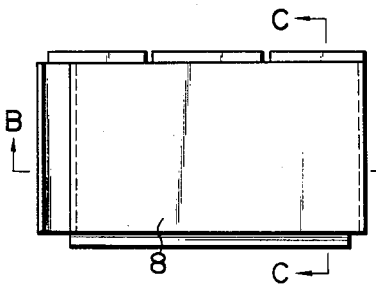
FIG. 4A is a plan view of a weather hood.
Figure 4C:
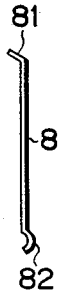
FIGS. 4B and 4C are respectively the cross sectional views on lines B—B and C—C of FIG. 4A.
Figure 4B:
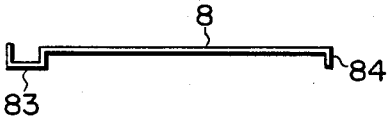
Figure 8A:
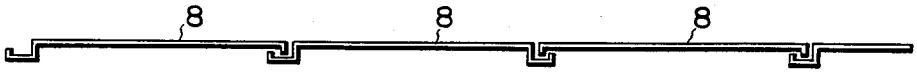
FIG. 8A is a cross sectional view on line VIII—VIII of FIG. 6.
Figure 8B:
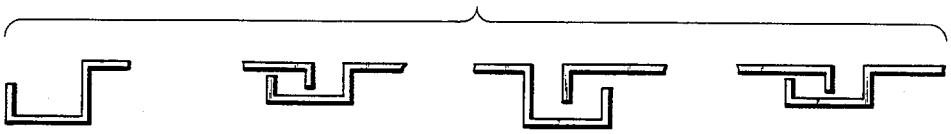
FIG. 8B is an enlarged view of the connecting sections of the adjacent weather hoods.

The weather hood 8 is constructed by bending the four sides of a metal plate by means of a press (FIG. 4). One lateral side of the weather hood 8 (as viewed from FIG. 4) is bent to provide a fitting section 81 which allows for the attachment of said weather hood 8 to the peripheral tank wall 1. The other lateral side of the weather hood 8 is provided with a U-shaped section 82 sliding along the surface of the guide 9. A groove 83, whose cross section is shaped like a trough, is provided on the left crosswise side of the weather hood 8. The right crosswise side of the weather hood 8 is provided with a bent section 84 to be engaged with the groove 83 of the adjacent hood 8. Both left and right engagement sections of the adjacent weather hoods 8 are assembled together in the form, shown in FIG. 8, to prevent rain drops from being blown into the oil tank. The fitting section 81 of one lateral side of the weather hood 8 is fixed to the seal shoe 2 by means of a keep plate 15 (FIG. 5). An inclined guide bar 9 is fixed to the edge of the upper plate 5*b* of the pontoon 5. The U-shaped section 82, provided on the other lateral side of the weather hood 8, is slidably fitted to the guide bar 9 by means of a bolt 16 (FIG. 5) bent in the U-shape. As a result, the weather hood 8 is prevented from being blown upward by a strong gust of wind. The angle at which the guide 9 is inclined is so chosen that each time the seal space varies, the weather hood 8 can be moved in an almost parallel relationship, thereby saving the weather hood 8 from unnecessary stresses.

A floating roof-type oil-tank sealing device embodying this invention, constructed as described above, offers the advantages that the oil tank can be effectively sealed and rain drops are reliably prevented from entering the oil tank.

What is claimed is:

1. A floating roof-type oil-tank sealing device for sealing a space between an outer rim of a floating pontoon and a seal shoe which slides on the inner surface of a tank wall, comprising:

an elongate inclined connector which extends between a lower portion of the outer rim of the floating pontoon and an upper portion of the seal shoe, and pins at both ends of said connector for pivotally supporting the connector ends on the outer rim and the seal shoe;

a compression spring, connected at its ends between said inclined connector and the outer rim of the pontoon, to apply a pressing force to said connector to urge the seal shoe against the tank inner wall;

a seal member provided between the lower portion of the outer rim of the pontoon and that portion of the seal shoe which faces said lower portion, so as to be in contact with the level of stored oil in the oil tank;

guide bar means extending from an upper part of the pontoon; and a weather hood arranged for sliding movement along said guide bar means, wherein said hood is connected at one edge to an upper end portion of the seal shoe and an opposite edge of said hood slides along said guide bar means when the pontoon moves relative to the tank inner wall, said weather hood being constructed by bending the peripheral edges of a number of rectangular steel plates, and wherein said guide bar means is formed in a rod shape inclined with respect to the upper part of the pontoon, and said opposite edge of the weather hood is provided with a U-shaped bolt for slidably engaging the rod-shaped guide bar means.

2. The oil-tank sealing device, according to claim 1, wherein the seal member is prepared from one selected from the group consisting of nitrile butadiene rubber and fluorine rubber.

* * * * *